United States Patent [19]

Sugiyama et al.

[11] Patent Number: 5,017,147

[45] Date of Patent: May 21, 1991

[54] CONNECTORS WITH COVER PROVIDING CONNECTION SEQUENCE CONTROL

[75] Inventors: Masaaki Sugiyama; Naoki Manabe, both of Kosai, Japan

[73] Assignee: Yazaki Corporation, Tokyo, Japan

[21] Appl. No.: 521,942

[22] Filed: May 11, 1990

[30] Foreign Application Priority Data

May 15, 1989 [JP] Japan ..... 1-054443[U]

[51] Int. Cl.[5] ..... H01R 13/44; H01R 13/639

[52] U.S. Cl. ..... 439/144; 439/299; 439/372; 439/924

[58] Field of Search ..... 439/133, 142, 143, 144, 439/299, 300, 345, 347, 372, 924, 355, 489

[56] References Cited

U.S. PATENT DOCUMENTS

| | | | |
|---|---|---|---|
| 3,982,804 | 9/1976 | Marechal | 439/142 |
| 4,542,946 | 9/1985 | Snow | 439/924 |
| 4,767,347 | 8/1988 | Kamp et al. | 439/133 |
| 4,867,699 | 9/1989 | Oda et al. | 439/350 |
| 4,941,839 | 7/1990 | Nagasaka | 439/352 |

*Primary Examiner*—Neil Abrams

*Attorney, Agent, or Firm*—Armstrong, Nikaido, Marmelstein, Kubovcik & Murray

[57] ABSTRACT

The electric junction box of this invention has a plurality of connector receiving sockets mounted on its insulating box. Selected one of the connector receiving sockets, or the first connector receiving socket, is attached with a locking cover, which is urged by a spring to lie flat over the adjacent or second connector receiving socket. A first connector can be assembled onto the first socket but a second connector cannot be connected to the second socket unless the locking cover is erected and locked onto the first connector. To rule out the slightest possibility of erroneous connection sequence, a connection sequence check member is provided to the second connector. Should the second connector be assembled onto the mating socket first, prior to the first connector, by erecting the locking cover, the connection sequence check member abuts against the back of the locking cover to cause the locking cover to advance in the way of the first connector, so that the first connector is blocked and cannot be assembled onto the associated socket, alerting the assembly worker to the wrong sequence of the connector assembly.

5 Claims, 5 Drawing Sheets

CONNECTORS WITH COVER PROVIDING CONNECTION SEQUENCE CONTROL

BACKGROUND OF THE INVENTION

The present invention relates to an electric junction box used in automotive electric wiring and more particularly to an electric junction box in which one of connector receiving sockets on the insulating box is provided with a mechanism for doubly locking the connector inserted and also for preventing a wrong mating connector from being assembled to enhance safety and reliability in connection.

PRIOR ART

To prevent erroneous connection between the electric junction box and the wiring harnesses, a structure shown in FIG. 7 has commonly been used. On an insulating box 1 of the electric junction box A are mounted connector receiving sockets $\mathbf{2}_1$, $\mathbf{2}_2$, $\mathbf{2}_3$, . . . of different shapes. The wiring harnesses 3 are terminated at their ends with connectors $\mathbf{4}_1$, $\mathbf{4}_2$, $\mathbf{4}_3$, . . . that have the shapes corresponding to those of the mating connector receiving sockets to prevent erroneous engagement between them.

To ensure engagement between the connector receiving sockets and the mating connectors, the connectors are each provided with a locking arm 5 that has a projection 6. The connector receiving socket is formed with a retainer portion 7 that engages with the locking arm 5.

PROBLEMS TO BE SOLVED BY THE INVENTION

With the conventional electric junction box, in confirming the engagement between the connector receiving socket and the mating connector, one has to rely on the clicking noise produced when the retainer portion 7 engages with the locking arm 5 or visually check the locked condition.

However, since the assembly work is manually performed, there is a possibility that the assembly worker may overlook the half-engaged or half-locked condition. This kind of assembly failure must never happen on such wiring systems as an airbag device that will affect the safety of human life.

In light of the above problems encountered with the conventional junction boxes, this invention has been accomplished to provide an electric junction box which has in the connector receiving socket a double locking mechanism and a mechanism to prevent erroneous engagement with a wrong mating connector.

SUMMARY OF THE INVENTION

To achieve the above objective, the electric junction box according to this invention comprises: an insulating box; a plurality of connector receiving sockets mounted on the insulating box, said connector receiving sockets including a first socket and a second socket, each connector receiving socket having a locking means to hold a mating connector in the connected condition; a locking cover rotatably mounted to a side wall of said first sockets that faces said second socket, said locking cover being adapted to hold the mating connector or first connector in the connected condition; and a locking means provided between said first socket and said locking cover.

The locking cover for fixing the first connector falls onto the second socket by its own gravity to prevent a second connector from being inserted into the second socket. It is preferable that a spring be installed between the locking cover and the first socket to ensure that the second connector cannot be assembled onto the second socket unless the locking cover is erected against the spring force and locked onto the first socket.

DESCRIPTION OF THE PREFERRED EMBODIMENT

Now, the present invention will be described by referring to the accompanying drawings that illustrate some embodiments.

Figure 1:
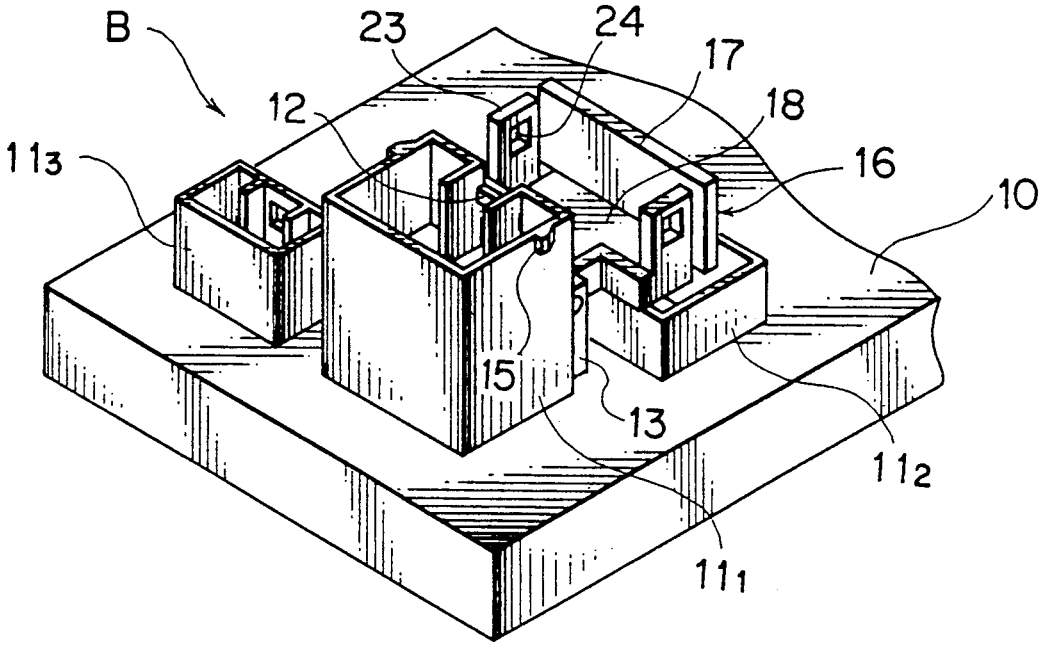
FIG. 1 is a perspective view of an essential portion of the electric junction box as one embodiment of this invention.
Figure 2:
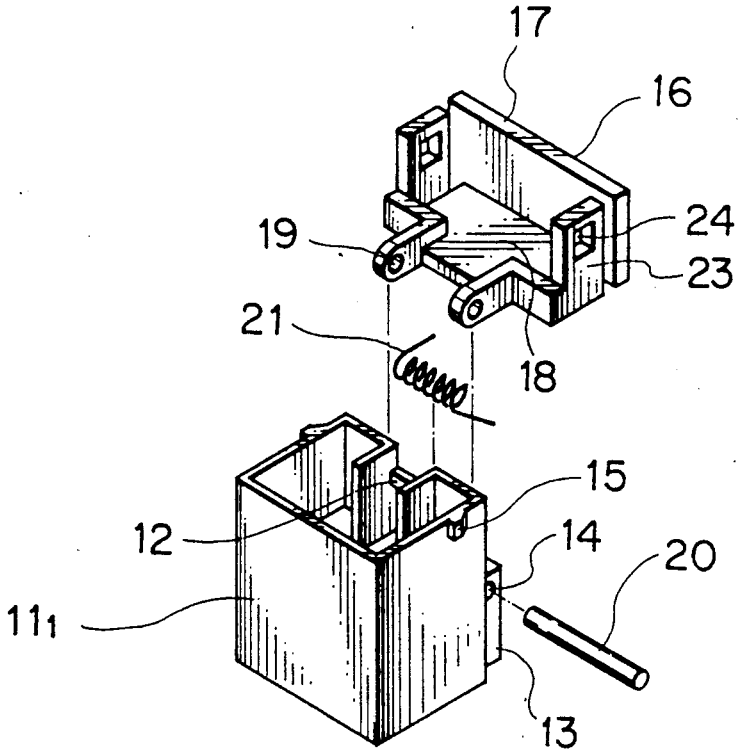
FIG. 2 is an exploded perspective view of FIG. 1.

FIG. 1 shows the perspective view showing the essential portion of the electric junction box according to this invention; and FIG. 2 shows the exploded perspective view of the same.

In the drawings, on an insulating box 10 of the electric junction box 8 are provided a plurality of connector receiving sockets $\mathbf{11}_1$, $\mathbf{11}_2$, . . . These connector receiving sockets are formed different in shape and color from each other. They also are provided with a retainer portion 12 that locks the mating connector attached to the end of the wiring harness.

The construction mentioned so far is similar to that of the conventional junction box. The features of this invention follow. Any desired connector receiving socket $\mathbf{11}_1$ is provided with a rotatable locking cover 16 that faces the adjacent connector receiving socket $\mathbf{11}_2$. The locking cover 16, which is intended to lock the mating connector, consists of a cover plate 17 for the mating connector and a support plate 18 and is formed in an L shape in cross section.

The support plate 18 has shaft holes 19 at the base end, through which is inserted a pin shaft 20, both ends of which are supported on bearings 14 of a bearing plate 13 so that the locking cover 16 can be rotated toward or away from the connector receiving socket $\mathbf{11}_1$.

A coil spring 21 is wound on the pin shaft 20 with one end of the spring 21 engaged in a spring receiver groove 22 of the support plate 18 and the other end engaged with the side wall of the connector receiving socket $\mathbf{11}_1$. Thus, the locking cover 16 in normal condition is urged to rotate toward and lie flat on the adjacent connector receiving socket $\mathbf{11}_2$, with the support plate 18 covering the engagement portion $\mathbf{11}_2$.

The locking cover 16 also has, on each side of the support plate 18, flexible arms 23 that are each formed with an opening 24. The end walls of the connector receiving socket $\mathbf{11}_1$ are provided with claws 15. The flexible arms 23 and the claws 15 cooperate to form a locking means.

In the insulating box 10 are accommodated wiring boards such as printed circuit boards and busbar circuit boards, both making up the internal circuits. Terminals that connect to the wiring boards are installed in the connector receiving sockets $\mathbf{11}_1$, $\mathbf{11}_2$, . . . Their arrangement may be made in accordance with the conventional configuration and is not shown.

OPERATION

Figure 3A:
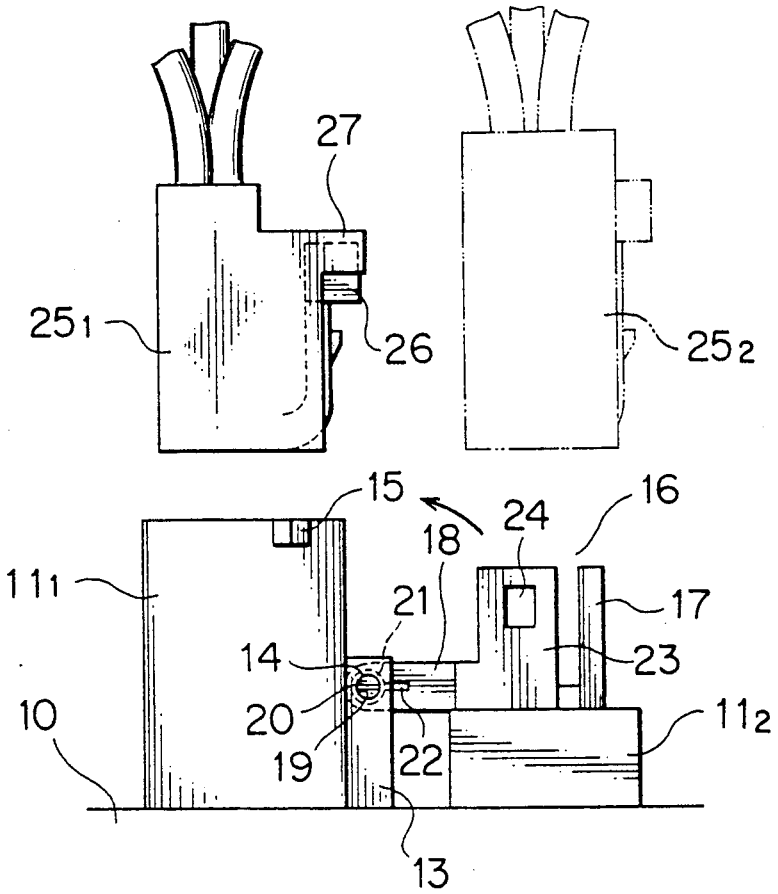
FIGS. 3A and 3B are side views of the junction box being assembled with mating connectors.

Referring to FIG. 3A, connectors $\mathbf{25}_1$ and $\mathbf{25}_2$ are to mate with the connector receiving sockets $\mathbf{11}_1$ and $\mathbf{11}_2$, respectively. The locking cover 16 is urged by the coil spring 21 to lie flat on the adjacent connector receiving socket $\mathbf{11}_2$, so that the second connector $\mathbf{25}_2$ cannot be engaged before the connector $\mathbf{25}_1$ is assembled. Therefore not only can erroneous engagement of wrong connectors be prevented but the order of connector assembly can also be checked. Then, the connector $\mathbf{25}_1$ is inserted into the connector receiving socket $\mathbf{11}_1$, and the locking arm 26 and the retainer portion 12 cooperate to provide a first locking.

Figure 3B:
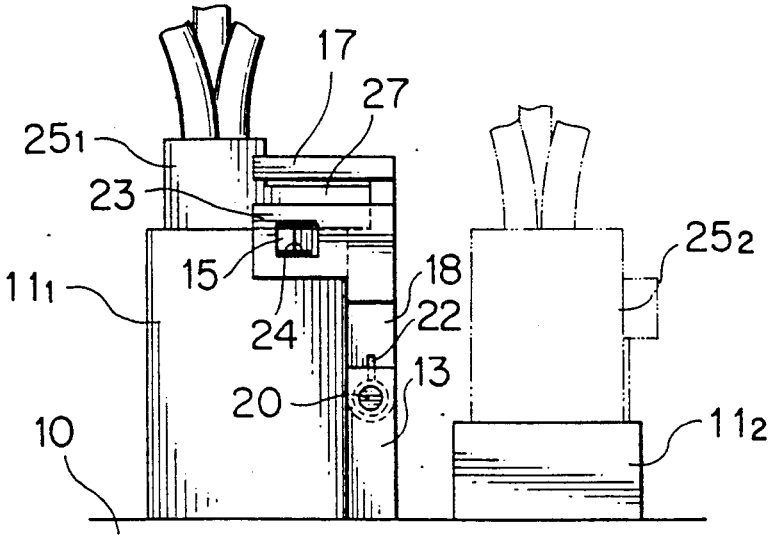

Next, as shown in FIGS. 3A and 3B, the locking cover 16 is rotated and erected as indicated by the arrow. The openings 24 of the arm 23 and the claws 15 engage to lock the cover 16 onto the connector receiving socket $\mathbf{11}_1$, while at the same time projecting pieces 27, 27 formed at the upper part of the connector $\mathbf{25}_1$ are pressed from above by the cover plate 17. As a result, the connector $\mathbf{25}_1$ is doubly locked. The projecting pieces 27 may be omitted as long as the cover plate 17 of the locking cover 16 encloses a part of the connector $\mathbf{25}_1$. If the projecting pieces 27 are formed to match the shape of the cover plate 17 or the support plate 18, it can function as a means to prevent erroneous engagement between the connector and the connector receiving socket. Therefore, it is possible to provide the projecting pieces 27 on the cover side.

When the connector $\mathbf{25}_1$ is completely engaged with and locked to the connector receiving socket $\mathbf{11}_1$ but if the locking cover 16 is not locked, the cover 16 is urged by the coil spring 21 to lie flat blocking the insertion of the second connector $\mathbf{25}_2$. Therefore, when the connector $\mathbf{25}_1$ is locked, it is necessarily doubly locked to the connector receiving socket $\mathbf{11}_1$. If the coil spring 21 is not installed, the locking cover 16 falls by its own weight, achieving the same effect.

In this way, the use of the above-mentioned connector $\mathbf{25}_1$ and its associated connector receiving socket $\mathbf{11}_1$ in such wiring systems as the airbag device will provide a very safe and reliable electric connection.

OTHER EMBODIMENTS

The standard procedure for assembling the connectors onto the electric junction box B consists, as described in FIGS. 3A and 3B, in engaging the first connector $\mathbf{25}_1$ with the connector receiving socket $\mathbf{11}_1$, locking the locking cover 16 to provide a double locking, and then engaging the second connector $\mathbf{25}_2$ with the associated connector receiving socket 112.

Figure 4A:
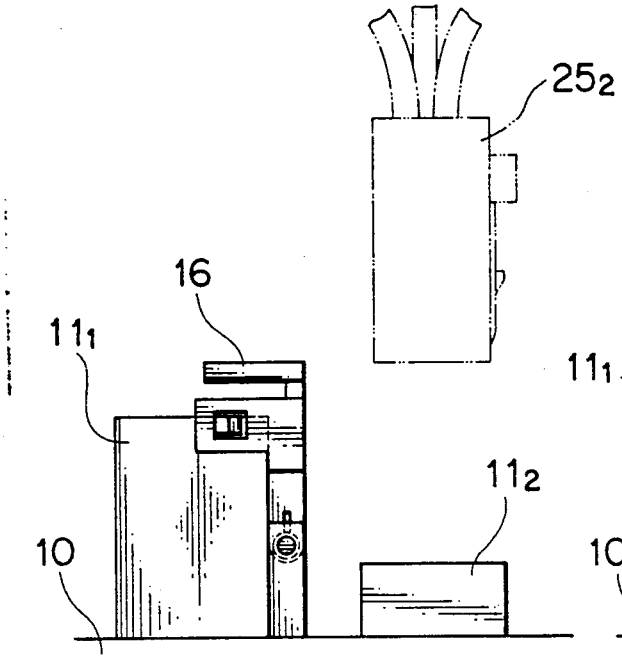
FIGS. 4A to 4D are side views of the junction box when the connector assembly order is different from that of FIG. 3.
Figure 4B:
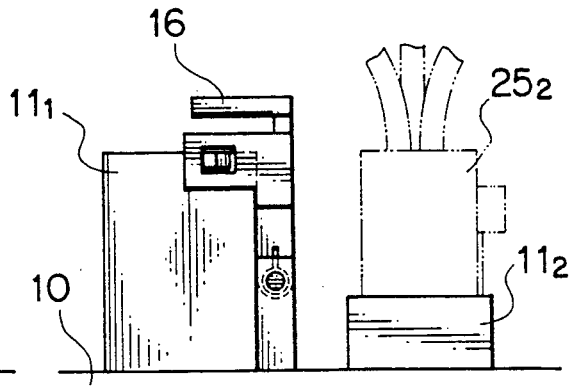
Figure 4D:
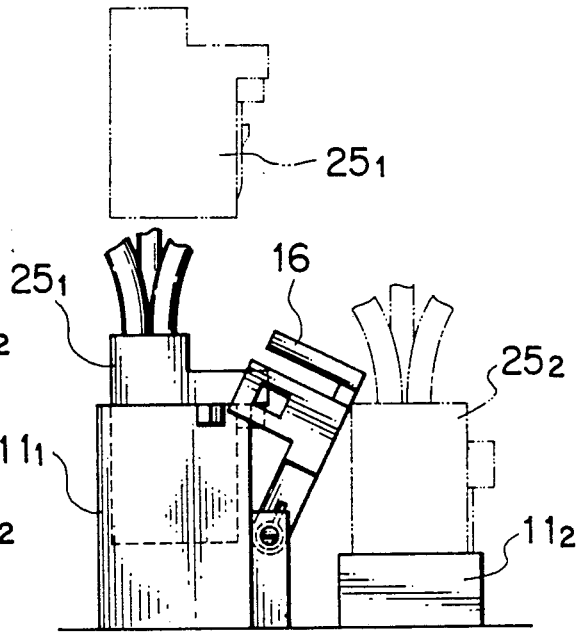
Figure 4C:
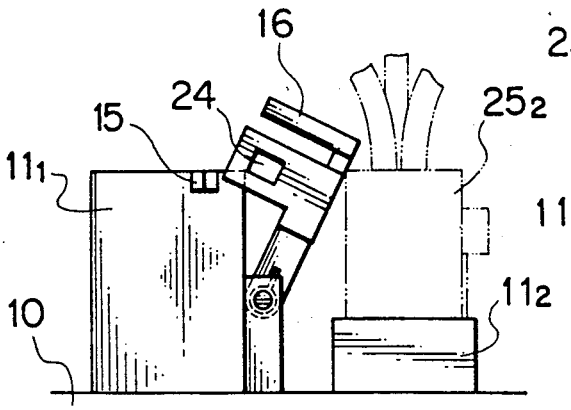

However, there may be a case where, as shown in FIGS. 4A and 4B, the second connector $\mathbf{25}_2$ is engaged first by erecting the locking cover 16 by hand. In such a case, as shown in FIG. 4C, the locking cover 16 inclines toward the second connector $\mathbf{25}_2$ by the coil spring 21 or by its own weight, so that the top part of the connector receiving socket $\mathbf{11}_1$ is left fully accessible to the connector $\mathbf{25}_1$. Hence, as shown in FIG. 4D, the connector $\mathbf{25}_1$ can be inserted after the second connector $\mathbf{25}_2$.

This assembly procedure, however, is not the standard one and hinders the correct functioning of the connector checking circuit (not shown), so it is desired that a means to check wrong connection sequence be provided.

Figure 5:
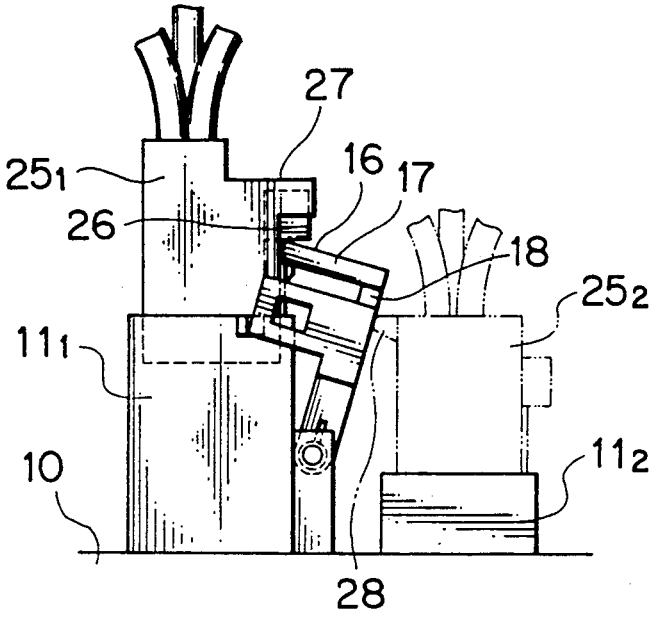
FIG. 5 is a side view showing the essential portion of the electric junction box as another embodiment of this invention.

FIG. 5 is a side view showing a still another embodiment of the electric junction box that has a connection sequence check member. The second connector $\mathbf{25}_2$ is provided with a connection sequence check projection 28 on its side facing the locking cover 16. This projection 28 contacts the support plate 18, causing the locking cover 16 to advance toward the connector receiving socket $\mathbf{11}_1$ and to maintain its inclined posture at a specified inclination angle, so that the cover plate 17 works as a stopper for the connector $\mathbf{25}_1$ abutting against the projecting pieces 27 or the locking arms 26.

In this embodiment, when the second connector $\mathbf{25}_2$ is first engaged, the connector $\mathbf{25}_1$ is prevented halfway from engaging with the connector receiving socket $\mathbf{11}_1$, automatically checking the wrong connecting sequence, thus alerting and prompting an assembly worker to correct the assembly sequence.

While in FIG. 5 the projection 28 as the connection sequence check member is shown provided on the second connector $\mathbf{25}_2$ side, it may be provided on the support plate 18 of the locking cover 16.

Figure 6:
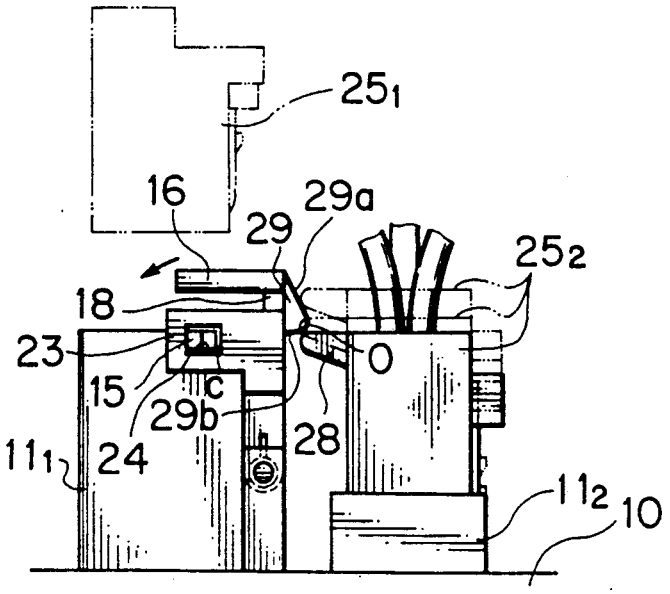
FIG. 6 is a side view showing the essential portion of the electric junction box as still another embodiment of this invention.
Figure 7:
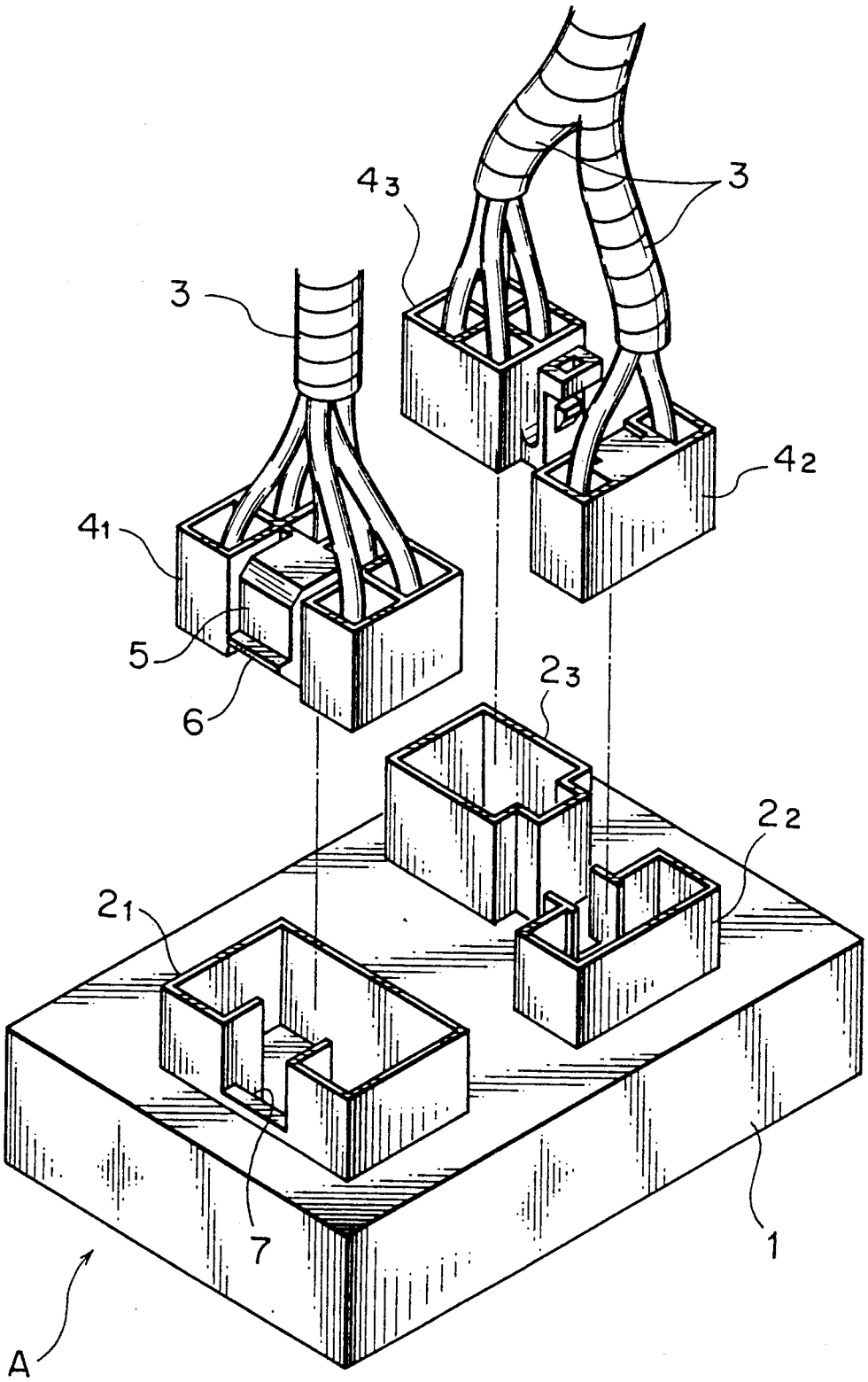
FIG. 7 PRIOR ART
FIG. 7 is a perspective view showing the essential portion of a conventional electric junction box.

FIG. 6 illustrates another junction box improved over the one shown in FIG. 5. A projection 29 facing the projection 28 of the second connector $\mathbf{25}_2$ is provided to the support plate 18. The projection 29 is an angle in shape and has a moderate slant surface 29*a* on the upper side and a steep slant surface 29*b* on the lower side. The height h of the apex O of the projection 29 from the support plate 18 is such that when the projection 28 contacts the apex O of the projection 29, the openings 24 of the locking cover 16 engage with the claws 15 of the connector receiving socket $\mathbf{11}_1$ to lock the cover 16.

With this embodiment, if the second connector $\mathbf{25}_2$ is engaged first, the projection 29 comes into sliding contact with the moderate slant surface 29*a* of the projection 29. And when the projection 28 reaches the apex O, the locking cover 16 is vertically erected and locked to the connector receiving socket $\mathbf{11}_1$, thus blocking the connector $\mathbf{25}_1$ from being inserted afterwards.

The engaged second connector $\mathbf{25}_2$ can smoothly be pulled out. Because of the clearance c between the opening 24 and the claw 15, the locking cover 16 inclines in the direction of arrow when the projection 28 and the apex O of the projection 29 are in the sliding contact, thus allowing the second connector to move upward. Then, the locking cover 16 is unlocked from the connector receiving socket $\mathbf{11}_1$ before assembling the connector $\mathbf{25}_1$.

The advantages of this invention may be summarized as follows. The junction box of the invention automatically prevents imperfect engagement between the connectors and their associated connector receiving sockets or even eliminates the possibility of the assembly worker forgetting to assemble them. It also provides a double locking of the connector, thus making safe and reliable electric connection.

Provision of the projecting piece 27 as an erroneous engagement preventing member between the connector to be inserted into the connector receiving socket and the locking cover prevents the wrong connector from being assembled into the connector receiving socket.

Furthermore, provision of the connection sequence check member (projection 29) to at least either the locking cover or the second connector facing it can prevent erroneous connector assembly sequence.

Moreover, the projection facing the connection sequence check member forcibly locks the locking cover to the connector receiving socket as the second connector is inserted, thereby preventing the wrong sequence of connector engagement more reliably.

What is claimed is:

1. An electric junction box comprising:

an insulating box;

a plurality of connector receiving sockets mounted on the insulating box, said connector receiving sockets including a first socket and a second socket, each connector receiving socket having a locking means to hold a mating connector in the connected condition;

a locking cover rotatably mounted to a side wall of said first socket, which faces said second socket, said locking cover being adapted to cover said first socket in an erected position and to extend over said second socket in a fallen position and thereby prevent connection of a mating connector to said second socket, said locking cover in the erected position being adapted to hold the corresponding mating connector in the connected position in said first socket; and a locking means provided between said first socket and said locking cover for holding said locking cover in the erected position.

2. An electric junction box as set forth in claim 1, wherein a spring is installed between the first socket and the locking cover to urge the locking cover to rotate toward the second socket.

3. An electric junction box as set forth in claim 1, wherein said locking cover consists of a cover plate for a part of the mating connector and a support plate for the cover plate, and an erroneous engagement prevention piece is provided to at least either the locking cover or the mating first connector.

4. An electric junction box as set forth in claim 1, wherein a connection sequence checking projection is provided at least either to said locking cover or to a wall of a second connector inserted in said second socket which faces the locking cover, so that the engagement between the connection sequence checking projection and the opposing wall surface maintains the inclined posture of the locking cover at a specified angle, thereby making it possible to stop the first connector engaging with said second socket halfway.

5. An electric junction box as set forth in claim 1, wherein said connection sequence checking projection is provided either to said locking cover or to the wall of the second connector inserted in the second socket which faces the locking cover, and an engagement projection that faces the connection sequence checking projection is provided to the other member—the locking cover or the facing wall—so that as these two projections come into sliding contact with each other, the locking cover is locked to said second socket.

* * * * *